United States Patent [19]

Masaki et al.

[11] Patent Number: 4,994,337

[45] Date of Patent: Feb. 19, 1991

[54] PHOTOSENSITIVE MEMBER HAVING AN OVERCOAT LAYER

[75] Inventors: Kenji Masaki; Izumi Osawa; Isao Doi, all of Osaka, Japan

[73] Assignee: Minolta Camera Kabushiki Kaisha, Osaka, Japan

[21] Appl. No.: 206,705

[22] Filed: Jun. 16, 1988

[30] Foreign Application Priority Data

| | | | |
|---|---|---|---|
| Jun. 17, 1987 | [JP] | Japan | 62-150897 |
| Jun. 17, 1987 | [JP] | Japan | 62-150896 |
| Jun. 17, 1987 | [JP] | Japan | 62-150897 |
| Jun. 17, 1987 | [JP] | Japan | 62-150898 |
| Jun. 17, 1987 | [JP] | Japan | 62-150899 |

[51] Int. Cl.[5] ..... G03G 5/14

[52] U.S. Cl. ..... 430/67; 430/132

[58] Field of Search ..... 430/67, 66, 84, 95, 430/132

[56] References Cited

U.S. PATENT DOCUMENTS

| | | | |
|---|---|---|---|
| 3,956,525 | 5/1986 | Yasuba | 427/41 |
| 4,148,637 | 4/1979 | Kubota et al. | 430/66 |
| 4,340,404 | 2/1984 | Hosoya et al. | 430/58 |
| 4,366,208 | 12/1982 | Akai et al. | 428/421 |
| 4,394,425 | 7/1983 | Shimizu et al. | 430/65 |
| 4,490,450 | 12/1984 | Shimizu et al. | 430/57 |
| 4,544,617 | 10/1985 | Mort et al. | 430/58 |
| 4,559,289 | 12/1985 | Sunagawa et al. | 430/66 |
| 4,634,648 | 1/1987 | Jansen et al. | 430/84 |
| 4,675,265 | 6/1987 | Kazama et al. | 430/67 |
| 4,755,444 | 7/1988 | Karakida et al. | 430/66 |
| 4,770,966 | 9/1988 | Kazama et al. | 430/84 |
| 4,801,515 | 1/1989 | Iino et al. | 430/66 |

FOREIGN PATENT DOCUMENTS

| | | |
|---|---|---|
| 50-30526 | 3/1974 | Japan . |
| 51-46130 | 10/1974 | Japan . |
| 53-23636 | 3/1978 | Japan . |
| 53-111734 | 9/1978 | Japan . |
| 54-115134 | 9/1979 | Japan . |
| 55-86169 | 6/1980 | Japan . |
| 56-62254 | 5/1981 | Japan . |
| 57-64239 | 4/1982 | Japan . |
| 58-139154 | 8/1983 | Japan . |
| 59-58432 | 4/1984 | Japan . |
| 59-58437 | 4/1984 | Japan . |
| 60-249155 | 5/1985 | Japan . |
| 60-101541 | 6/1985 | Japan . |
| 61-94056 | 5/1986 | Japan . |
| 62-27748 | 2/1987 | Japan . |
| 62-31862 | 2/1987 | Japan . |
| 1174171 | 12/1969 | United Kingdom . |

OTHER PUBLICATIONS

A. Dilkes, S. Kaplan, and A. Vanlaeken, "A C-NMR Investigation of Plasma Polymerized Ethane, Ethylene, and Acetylene", Xerox Webster Research Center.

"Formation of an Amorphous Powder During the Polymerization of Ethylene in a Radio-Frequency Discharge", *Journal of Applied Polymer Science*, vol. 17, 1973, New York.

*A Review of Recent Advances in Plasma Polymerization*, Shen and Bell, Dept. of Chem. Engineering, U of Calif. Berkeley CA 94720.

*Thin Solid Films*, vol. 119(1984) 121-126, "Optical and Interfaci Electronic Properties of Diamond-Like Carbon Films".

Philisophical Magazine, 1976, vol. 33, No. 6, 935-949, "Electronic Properties of Substantially Doped Amorphous Si and Ge" Spear et al.

Nikkei New Materials, Dec. 15, 1986.

*Primary Examiner*—John Goodrow

*Attorney, Agent, or Firm*—Burns, Doane, Swecker & Mathis; Burns, Doane, Swecker & Mathis

[57] ABSTRACT

A photosensitive member of the present invention comprises an electrically conductive substrate, a photoconductive layer and an overcoat layer.

The photoconductive layer comprises selenium-arsenic alloy layer, or selenium layer and selenium-tellurium layer formed in this order. The overcoat layer comprises amorphous carbon containing hydrogen atoms, halogen atoms and at least one element selected from the group consisting of chalcogen, oxygen, nitrogen and elements in Group III and IV of the periodic table.

The photosensitive member of this construction is harmless and excellent in electrophotographic characteristics inclusive of durability and surface hardness.

11 Claims, 3 Drawing Sheets

PHOTOSENSITIVE MEMBER HAVING AN OVERCOAT LAYER

BACKGROUND OF THE INVENTION

1. Field of the Invention

The present invention relates to a photosensitive member comprising an overcoat layer on a monolayer construction of selenium-arsenic alloy or a laminate-layer construction of selenium-tellurium alloy.

2. Description of the Prior Art

Photosensitive members of amorphous selenium have been well known, and there have been many attempts to improve the disadvantages in heat resistance, spectral sensitivity, dark decay and the like of such members. For example, arsenic is doped into a selenium layer, or selenium-tellurium alloy layer is formed on a selenium layer to obtain a photosensitive member of laminated structure.

It has conventionally been well known that photosensitive members composed of selenium-arsenic alloys (hereinafter referred to as Se-As) have the highest photosensitivity in spectral luminous efficiency of all the members and that members comprising a selenium layer having a selenium-tellurium layer (hereinafter referred to as Se-Te) laminated thereon has the highest sensitivity in long wavelength light which is required for a printer using semiconducting laser beams as a light source.

However, conventional Se-As and Se-Te photosensitive members in common use have the following disadvantages. One disadvantage is that they are harmful to the human body. Although it is nearly impossible for the photosensitive member to come into direct contact with the human body, when such a photosensitive member is used in a copy machine, powder from said member adheres to the copy image due to surface friction caused by the member rubbing against the copy paper, cleaning materials, developer or other matter, and the powder is then discharged from the machine. Accordingly, when the copy is picked up by hand the person is directly contaminated by the selenium, arsenic and tellurium, the harmfulness of said substances being a matter for concern. Another disadvantage is poor durability. The surface hardness of Se-As and Se-Te photosensitive members barely meets the H level of the JIS standards for pencil lead hardness, consequently, the surface is readily damaged when friction is generated during use of the machine as described previously, or repeated harsh surface contact is made during paper jams and the resultant reversion to manual remedies. This damage markedly reduces the image quality due to so-called whiteouts on the copy image, and shortens the useful life span of the photosensitive material.

In order to eliminate these disadvantages, the surface of the Se-As or Se-Te photosensitive member is covered with a protective layer.

For example, Japanese Unexamined Patent Publications Nos. SHO 53-23636 and SHO 53-111734 disclose photosensitive members having a specific silicide applied on a selenium, selenium-tellurium alloy, and selenium-cadmium alloy photoconductive layers and hardened to form an insulating layer. Japanese Unexamined Patent Publication No. SHO 59-58437 discloses a photosensitive member having an amorphous Si:N or Si:O layer of 50 angstroms to 2 microns in thickness formed on a selenium-arsenic alloy layer by the glow discharge process using silane gas and ammonia gas, or silane gas and nitrous oxide gas as starting materials. Japanese Unexamined Patent Publication No. SHO 60-61761 discloses a photosensitive member having an amorphous carbon or hard carbon layer formed on a photosensitive layer. Japanese Unexamined Patent Publication No. SHO 62-9355 discloses a photosensitive member having an overcoat layer of amorphous carbon formed on the surface of a photo-exciting layer comprising hydrogenated/halogenated amorphous carbon or hydrogenated amorphous silicon.

However, photosensitive members disclosed in Japanese Unexamined Patent Publications No. SHO 53-23636 and 53-111734 have a drawback that the surface of the members are readily damaged due to its poor surface hardness. Photosensitive members disclosed in Japanese Unexamined Patent Publications No. SHO 59-58437, 60-61761 and 62-9355 produce so-called image drift under conditions of high temperature and humidity. Particularly, Japanese Unexamined Patent Publication No. 60-61761 discloses a photoconductive layer of amorphous silicon. Therefore, when this technique is applied to the members composed of selenium, there arises a problem of reduced chargeability.

As apparent from the above, there is no disclosure in these publications of any means for resolving the basic disadvantages inherent in the aforementioned Se-As and Se-Te photosensitive members.

SUMMARY OF THE INVENTION

A main object of the present invention is to provide a non-injurious photosensitive member generally superior in electrophotographic characteristics and having high durability.

Still another object of the invention is to provide a photosensitive member which does not produce so-called image drift.

Still another object of the invention is to provide an overcoat layer of high hardness which has superior adhesion properties on the photosensitive member.

A further object of the invention is to provide a photosensitive member having an overcoat layer which does not separate from said member when put into actual service in a copy machine.

These and other objects of the present invention are achieved by providing a photosensitive member comprising a conductive substrate, a photosensitive layer formed by a selenium-arsenic alloy monolayer, or selenium and selenium-tellurium alloy layers formed in sequence, and an amorphous carbon overcoat layer provided over the photosensitive layer, said overcoat layer comprising halogen atoms and at least an atom selected from the group consisting of chalcogen atoms, oxygen atoms, nitrogen atoms and elements in Group III and IV of the periodic table.

BRIEF DESCRIPTION OF THE DRAWINGS

In the following description, like parts are designated by like reference numbers throughout the several drawings

DETAILED DESCRIPTION OF THE PREFERRED EMBODIMENTS

Figure 1:
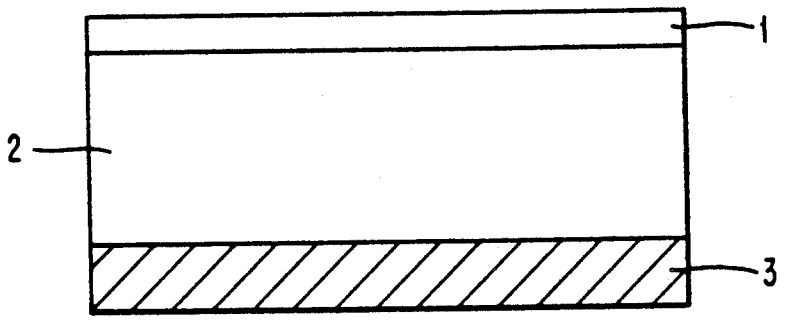
FIG. 1 is a diagram showing a photosensitive member embodying the invention.

FIG. 1 shows an example of the construction of a photosensitive member of the present invention wherein a conductive substrate 3 has sequentially laminated thereon a photosensitive layer 2 and an overcoat layer 1 formed of an amorphous hydrocarbon layer.

A photosensitive layer 2 is formed of a single layer composed of selenium-arsenic alloys (hereinafter referred to as Se-As member) on a conductive substrate 3, or formed of a selenium layer having a selenium-tellurium layer laminated thereon on a conductive substrate 3 (hereinafter referred to as Se-Te member).

The conductive substrate 3 may be at a minimum a material which is conductive on its outermost surface, and may be cylindrical, flexible belt, flat plate, or other arbitrary shape.

The characteristics of the present invention is an overcoat layer 1 having halogen atoms and at least one element selected from the group consisting of chalcogen atoms, oxygen atoms, nitrogen atoms and elements in Group III and IV of the periodic table in an amorphous carbon layer (hereinafter referred to as an a-C layer).

The amorphous carbon layer itself has a hardness rating of 4H, but becomes harder and damage resistant by means of the addition of halogen atoms, the addition of said atoms providing an overcoat layer 1 which has comparatively superior moisture resistance, assures suitable chargeability, and has superior transparency to light.

The halogen atoms may be fulorine, chlorine, bromine, or iodine atoms. Fluorine atoms in particular provide exceptionally superior results from the standpoint of moisture resistance.

The effective moisture resistance imparted by the addition of fluorine atoms is thought to be obtained from the introduction of strongly water-repellant fluorine atoms into the layer and the increased density of the layer due to a dehydration reaction induced by the fluorine atoms in the layer.

The a-C layer of the present invention contains 0.01 to 50 atomic %, preferably 0.1 to 10 atomic %, and ideally 0.5 to 5 atomic % of halogen atoms based on the total amount of constituent atoms of the entire structure.

The content of less than 0.01 atomic % of the halogen atoms is undesirable in view of moisture resistance. If the amount of halogen atoms exceeds 50 atomic % based on all the constituent atoms of the a-C layer, the appropriate layer formation cannot necessarily be assured.

Although the doping of halogen atoms results in improved moisture resistance, it does not afford sufficient characteristics in view of actual use of a photosensitive member.

More specifically, the a-C layer containing halogen atoms possesses excellent moisture resistance at the time of starting the use of the member and sufficient intensity of film after repeated use under environmental conditions of room temperature and room humidity. However, moisture resistance after a long use is not sufficient. Our inventors have found that the image drift may be produced under environmental conditions of 35° C. temperature and 80% of humidity after 10,000 copies were made.

This may be caused from the fact that film resistance toward the direction of the surface is reduced because water is attached thereto by breaking weak bonds formed in the layer due to corona discharge.

The present invention further adds at least one atom selected from the group consisting of chalcogen atoms, oxygen atoms, nitrogen atoms and elements in Group III and IV of the periodic table to the a-C layer in order to improve moisture resistance after repeated use.

The chalcogen atoms may be sulfur, selenium or tellurium atoms. The Group III elements may be boron, aluminum, gallium, indium or thallium atoms. The Group IV elements may be silicon, germanium, tin or lead atoms. These atoms are believed to have their weak bonds forcibly broken and reformed during the reaction without bond dissociation induced by corona discharge and the like due to the formation of strong bonds between chalcogen/carbon atoms, oxygen/carbon atom, nitrogen/carbon atoms, Group III/carbon atoms and Group IV/carbon atoms, with the result that moisture adhesion is prevented.

For this reason it is preferable that these atoms be used as separate material gases, to wit, it is desirable to conduct the reaction with the atoms in a temporarily dissociated state.

The amounts of chalcogen atoms, oxygen atoms, nitrogen atoms and elements in Group III and IV of the periodic table to be present in the a-C layer of the present invention is preferably about 0.01 to 20 atomic %, more preferably about 0.1 to 10 atomic %, and most preferably about 0.5 to 5 atomic based on all the constituent atoms of the a-C layer.

The amount of elements in Group IV of the periodic table to be present in the a-C layer of the present invention is preferably about 0.01 to 40 atomic %, more preferably about 0.1 to 15 atomic %, and most preferably about 0.5 to 5 atomic based on all the constituent atoms of the a-C layer.

The content of less than 0.1 atomic % of these atoms is undesirable in view of moisture resistance after repeated use. If amounts of chalcogen atoms, oxygen atoms, nitrogen atoms and elements in Group III and IV of the periodic table exceeds 20 atomic % or the amount of IV atoms of the periodic table exceeds 40 atomic % based on all the constituent atoms of the a-C layer, the appropriate layer formation cannot necessarily be assured. In particular, a remarkable layer etching effect caused by the oxygen atoms during the layer formaiton process leads to an undesirable reduction in the speed of layer formation.

Although there is no particular limitation on the amount of the above-mentioned atoms which may be contained in the a-C layer, the amount is necessarily restricted from the perspectives of the overcoat layer manufacturing and glow discharge processes.

Although there is no particular limitation on the amount of the hydrogen atoms which may be contained in the a-C layer, the amount is necessarily restricted from the perspectives of the overcoat layer manufacturing and glow discharge processes, said amount being, in general, 5 to 50 atomic %.

The contents of these atoms in the a-C layer can be determined by a usual method of elementary analysis, e.g. Auger electron spectroscopy or SIMS analysis. The a-C layer may contain chalcogen atoms, oxygen atoms, nitrogen atoms and elements in Group III and IV of the periodic table singly, and may contain two or more of the above types of atoms.

The overcoat layer 1 of the present invention is formed at a thickness of 0.01 to 5 microns, preferably 0.05 to 2 microns, and ideally 0.1 to 1 microns. A layer with a thickness of less than 0.01 micron has reduced hardness and is readily damaged. Also a layer with the thickness exceeding 5 microns has reduced transparency to light and causes reduced sensitivity of the photosensitive member because the exposed light cannot be effectively conducted to the selenium photosensitive layer.

The aforesaid halogen, chalcogen, oxygen, nitrogen and elements in Group III and IV may be incorporated so as to be distributed uniformly throughout the width of said overcoat layer 1 or may be incorporated in uneven distribution. When distributed unevenly, the region having the majority of these atoms in the direction of the layer thickness shall have these atoms in such amounts that they are within the ranges heretofore described.

High density distribution of halogen atoms in the vicinity of the surface of the layer in particular can be effected by post-layer formation plasma surface processing of the molecules containing the halogen atoms, in which case high density distributions of 40 to 50 atomic % is possible.

The overcoat layer 1 of the photosensitive member of the present invention may be formed on an Se-As member or Se-Te member, thus achieving the objects of the present invention.

The overcoat layer 1 is formed by means of a glow discharge process. The overcoat layer 1 is formed by discharging at reduced pressure gaseous-phase molecules containing at least carbon atoms and molecules containing hydrogen atoms together with molecules at least containing one element selected from the group consisting of chalcogen, oxygen,nitrogen and elements in Group III and IV, thereby diffusing on the substrate the activated neutral atoms and charged atoms in the plasma production region, and being induced by electrical or magnetic force or the like to form on the substrate in solid phase via a recombination reaction. The formation of the overcoat layer 1 can be regulated via the aforesaid plasma reaction (hereinafter referred to as a P-CVD reaction) to form an amorphous hydrocarbon layer incorporating at least chalcogen atoms, oxygen atoms, nitrogen atoms and III atoms and IV atoms of the periodic table.

These hydrocarbons need not always be in a gaseous phase at room temperature at atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2- methyl-2-butene, 1-hexene, tetramethylethylene, 1-heptene, 1-octene, 1-nonene, 1-decene and the like; diolefins such as allene, methyl-allene, butadiene, pentadiene, hexadiene, cyclopentadiene and the like; triolefins such as ocimene, alloocimene, myrcene, hexatriene and the like; acetylene, methylacetylene, 1-butyne, 2-butyne, 1-pentyne, 1-hexyne, 1-heptyne, 1-octyne, 1-nonyne, 1-decyne, butadyine and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

Considering the formation of a layer of good quality, unsaturated hydrocarbons are desirable because they are reactive. Especially, the most desirable compounds are butadiene and propylene in view of film-forming ability, ease of gas handling and cost.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the alternating electric field to be set up, increasing the intensity of a d.c. electric field superposed on the alternating electric field or desired combination of such procedures.

The halogen compounds to be used need not always be in a gaseous phase at room temperature at atmospheric pressure but can be in a liquid or solid phase insofar as they can be vaporized on melting, evaporation or sublimation, for example, by heating or in a vacuum. While halogens such as fluorine, chlorine, bromine and iodine are usable in this invention, examples of useful halogen compounds are inorganic compounds such as hydrogen fluoride, chlorine fluoride, bromine fluoride, iodine fluoride, hydrogen chloride, bromine chloride, iodine chloride, hydrogen bromide, iodine bromide and hydrogen iodide; and organic compounds such as alkyl halides, aryl halides, styrene halides, polymethylene halides, haloforms, halogen substituted hydrocarbons and the like. Examples of such alkyl halides are methyl fluoride, methyl chloride, methyl bromide, methyl iodide, ethyl fluoride, ethyl chloride, ethyl bromide, ethyl iodide, propyl fluoride propyl chloride, propyl bromide, propyl iodide, butyl fluoride, butyl chloride, butyl bromide, butyl iodide, amyl fluoride, amyl chloride, amyl bromide, amyl iodide, hexyl fluoride, hexyl chloride, hexyl bromide, hexyl iodide, heptyl fluoride, heptyl chloride, heptyl bromide, heptyl iodide, octyl fluoride, octyl chloride, octyl bromide, octyl iodide, nonyl fluoride, nonyl chloride, nonyl bromide, nonyl iodide, decyl fluoride, decyl chloride, decyl bromide, decyl iodide and the like. Examples of useful aryl halides are fluorobenzene, chlorobenzene, bromobenzene, iodobenzene, chlorotoluene, bromotoluene, chloronaphthalene, bromonaphthalene and the like. Examples of useful styrene halides are chlorostyrene, bromostyrene, iodostyrene, fluorostyrene and the like. Examples of useful polymethylene halides are methylene chloride, methylene bromide, methylene iodide, ethylene chloride, ethylene bromide, ethylene iodide, trimethylene chloride, trimethylene bromide, trimethylene iodide, dibutane chloride, dibutane bromide, dibutane iodide, dipentane chloride, dipentane bromide, dipentane iodide, dihexane chloride, dihexane bromide, dihexane iodide, diheptane chloride, diheptane bromide, diheptane iodide, dioctane chloride, dioctane bromide, dioctane iodide, dinonane chloride, dinonane bromide, didecane chloride, didecane iodide and the like. Examples of useful haloforms are fluoroform, chloroform, bromoform, iodoform and the like.

Useful examples of halogen substituted hydrocarbons are carbon tetrafluoride, vinylidene fluoride, perfluoroethylene, perfluoropropane, perfluoropropylene, difluoropropane, and the like.

From the perspectives of film-forming ability, ease of gas handling and cost, the most desirable compounds are carbon tetrafluoride, perfluoroethylene, perfluoropropylene and the like.

The amount of halogen atoms incorporated in the amorphous carbon layer can be regulated at least by means of increasing or decreasing the amount of molecules containing halogen atoms used in the P-CVD reaction.

Examples of molecules containing at least chalcogen atoms are $H_2S$, $CH_3(CH_2)_4S(CH_2)_4CH_3$, $CH_2{=}CHCH_2SCH_2CH{=}CH_2$, $C_2H_5SC_2H_5$, $C_2H_5SCH_3$, thiophene, $H_2Se$, $(C_2H_5)_2Se$, $H_2Te$ and the like.

From the perspectives of film-forming ability, ease of gas handling and cost, the most desirable compounds are $H_2S$, $H_2Se$ and the like.

While oxygen and ozone are usable for this purpose, examples of useful oxygen compounds are inorganic compounds such as water (water vapor), hydrogen peroxide, carbon monoxide, carbon dioxide, carbon suboxide; organic compounds having a functional group or linkage such as hydroxyl group (—OH), aldehyde group (—COH), acyl group (RCO— or —CRO), ketone group (>CO), ether linkage (—O—), ester linkage (—COO—), oxygen-containing heterocyclic ring or the like. Examples of useful organic compounds having a hydroxyl group include alcohols such as methanol, ethanol, propanol, butanol, allyl alcohol, fluoroethanol, fluorobutanol, phenol, cyclohexanol, benzyl alcohol and furfuryl alcohol. Examples of useful organic compounds having an aldehyde group are formaldehyde, acetaldehyde, propioaldehyde, butyraldehyde, glyoxal, acrolein, benzaldehyde, furfural and the like. Examples of useful organic compounds having an acyl group are formic acid, acetic acid, propionic acid, butyric acid, valeric acid, palmitic acid, stearic acid, oleic acid, oxalic acid, malonic acid, succinic acid, benzoic acid, toluic acid, salicylic acid, cinnamic acid, naphthoic acid, phthalic acid, furoic acid and the like. Examples of suitable organic compounds having a ketone group are acetone, ethyl methyl ketone, methyl propyl ketone, butyl methyl ketone, pinacolone, diethyl ketone, methyl vinyl ketone, mesityl oxide, methylheptenone, cyclobutanone, cyclopentanone, cyclohexanone, acetophenone, propiophenone, butyrophenone, valerophenone, dibenzyl ketone, acetonaphthone, acetothienone, acetofuron and the like. Examples of useful organic compounds having an ether linkage are methyl ether, ethyl ether, propyl ether, butyl ether, amyl ether, ethyl methyl ether, methyl propyl ether, methyl butyl ether, methyl amyl ether, ethyl propyl ether, ethyl butyl ether, ethyl amyl ether, vinyl ether, allyl ether, methyl vinyl ether, methyl allyl ether, ethyl vinyl ether, ethyl allyl ether, anisole, phenetole, phenyl ether, benzyl ether, phenyl benzyl ether, naphthyl ether, ethylene oxide, propylene oxide, trimethylene oxide, tetrahydrofuran, tetrahydropyran, dioxane and the like. Examples of useful organic compounds having an ester linkage are methyl formate, ethyl formate, propyl formate, butyl formate, amyl formate, methyl acetate, ethyl acetate, propyl acetate, butyl acetate, amyl acetate, methyl propionate, ethyl propionate, propyl propionate, butyl propionate, amyl propionate, methyl butyrate, ethyl butyrate, propyl butyrate, butyl butyrate, amyl butyrate, methyl valerate, ethyl valerate, propyl valerate, butyl valerate, amyl valerate, methyl benzoate, ethyl benzoate, methyl cinnamate, ethyl cinnamate, propyl cinnamate, methyl salicylate, ethyl salicylate, propyl salicylate, butyl salicylate, amyl salicylate, methyl anthranilate, ethyl anthranilate, butyl anthranilate, amyl anthranilate, methyl phthalate, ethyl phthalate, butyl phthalate and the like. Examples of useful heterocyclic compounds are furan, oxazole, furazane, pyran, oxazine, morpholine, benzofuran, benzoxazole, chromene, chroman, dibenzofuran, xanthene, phenoxazine, oxirane, dioxirane, oxathiorane, oxadiazine, benzoisooxazole and the like.

From the perspectives of film-forming ability, ease of gas handling and cost, the most desirable compounds are carbon dioxide, oxygen and the like.

While nitrogen per se is usable, examples of useful nitrogen compounds include inorganic compounds such as ammonia, and organic compounds having a functional group or linkage such as amino group ($NH_2$), cyano group (—CN), nitrogen-containing hetero-cyclic ring or the like. Examples of useful organic compounds having an amino group are methylamine, ethylamine, propylamine, butylamine, amylamine, hexylamine, heptylamine, octylamine, nonylamine, decylamine, undecylamine, dodecylamine, tridecylamine, tetradecylamine, pentadecylamine, cetylamine, dimethylamine, diethylamine, dipropylamine, dibutylamine, diamylamine, trimethylamine, triethylamine, tripropylamine, tributylamine, triamylamine, allylamine, diallylamine, triallylamine, cyclopropylamine, cyclobutylamine, cyclopentylamine, cyclohexylamine, aniline, methylaniline, dimethylaniline, ethylaniline, diethylaniline, toluidine, benzylamine, dibenzylamine, tribenzylamine, diphenylamine, triphenylamine, naphthylamine, ethylenediamine, trimethylenediamine, tetramethylenediamine, pentamethylenediamine, hexamethylenediamine, diaminoheptane, diaminooctane, diaminononane, diaminodecane, phenylenediamine and the like. Examples of useful organic compounds having a cyano group are acetonitrile, propionitrile, butyronitrile, valeronitrile, capronitrile, enanthonitrile, caprylonitrile, pelargonnitrile, caprinitrile, lauronitrile, palmitonitrile, stearonitrile, crotononitrile, malonitrile, succinonitrile, glutaronitrile, adiponitrile, bezonitrile, tolunitrile, cyanobenzylic cinnamonitrile, naphthonitrile, cyanopyridine and the like. Examples of useful heterocyclic compounds are pyrrole, pyrroline, pyrrolidine, oxazole, thiazole, imidazole, imidazoline, imidazolidine, pyrazole, pyrazoline, pyrazolidine, triazole, tetrazole, pyridine, piperidine, oxazine, morpholine, thiazine, pyridazine, pyrimidine, pyrazine, piperazine, triazine, indole, indoline, benzoxazole, indazole, benzimidazole, quinoline, cinnoline, phthalazine, phthalocyanine, quinazoline, quinoxaline, carbazole, acridine, phenanthridine, phenazine, phenoxazine, indolizine, quinolizine, quinuclidine, naphthyridine, purine, pteridine, aziridine, azepine, oxadiazine, dithiazine, benzoquinoline, imidazothiazole and the like.

From the perspectives of film-forming ability, ease of gas handling and cost, the most desirable compounds are nitrogen, ammonia and the like.

Examples of molecules containing at least III element of the periodic table are $B_2H_6$, $BCl_3$, $BBr_3$, $BF_3$, $B(OC_2H_5)_3$, $AlCl_3$, $Al(Oi\text{-}C_3H_7)_3$, $(CH_3)_3Al$, $(C_2H_5)_3Ga$, $(C_2H_5)_3In$ and the like.

From the perspectives of film-forming ability, ease of gas handling and cost, the most desirable compounds are diborane, trimethylaluminum and the like.

Examples of molecules containing at least IV element of the periodic table are $SiH_4$, $Si_2H_6$, $Si_2F_2H_4$, $Si(OCH_3)_4$, $Si(OCH_3)_4$, $GeH_4$, $GeF_4$, $Ge_2H_6$, $(OC_2H_5)_4Sn$, $Sn(OCH_3)_4$ and the like.

From the perspectives of film-forming ability, ease of gas handling and cost, the most desirable compounds are silane, germane and the like.

The amount of these atoms, i.e., chalcogen atoms, oxygen atoms, nitrogen atoms and III and IV atoms of the periodic table, incorporated in the a-C layer can be regulated at least by means of increasing or decreasing the amount of molecules containing these atoms in the P-CVD reaction.

Figure 2:
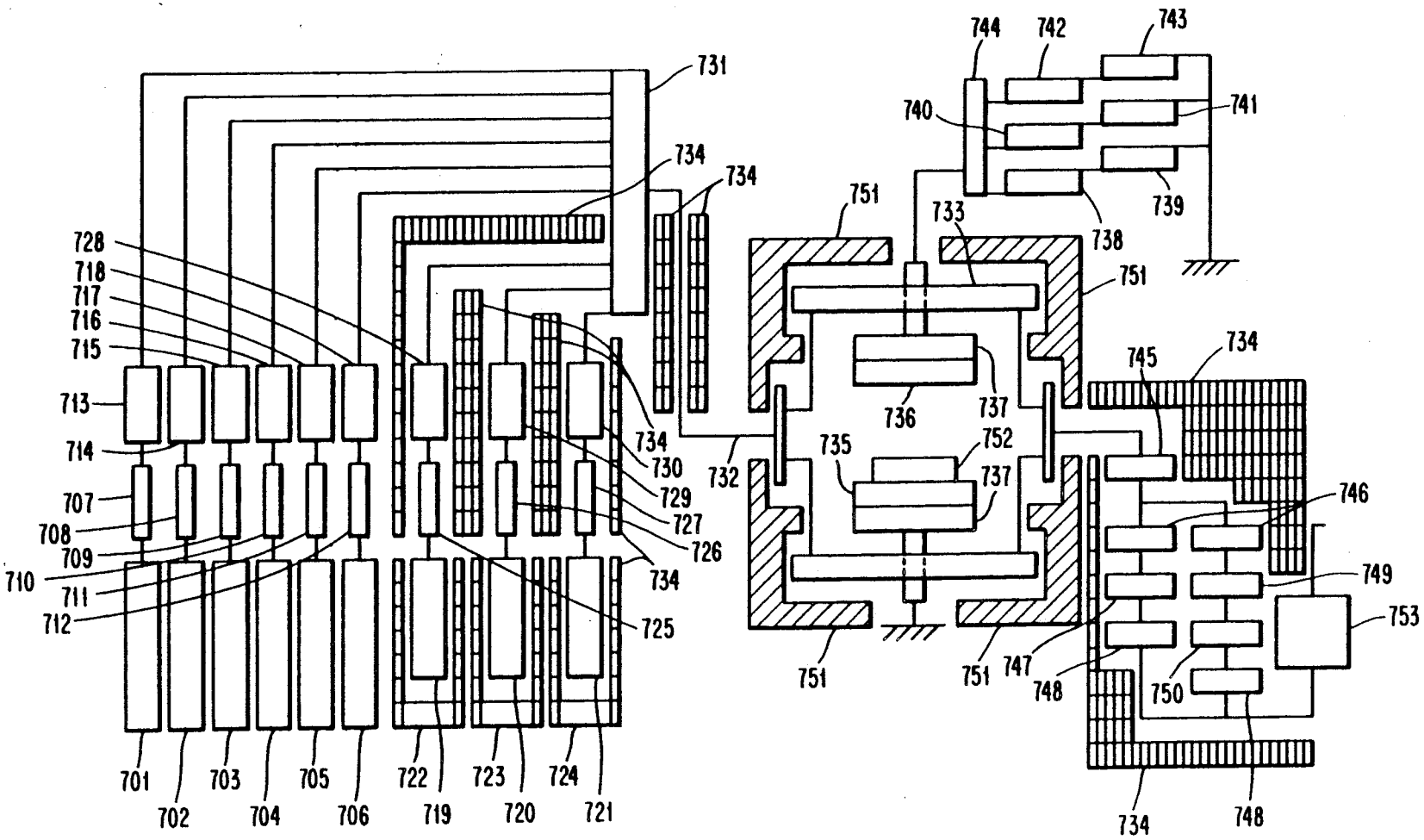
FIGS. 2 and 3 are diagrams showing apparatus for preparing photosensitive members of the invention.
Figure 3:
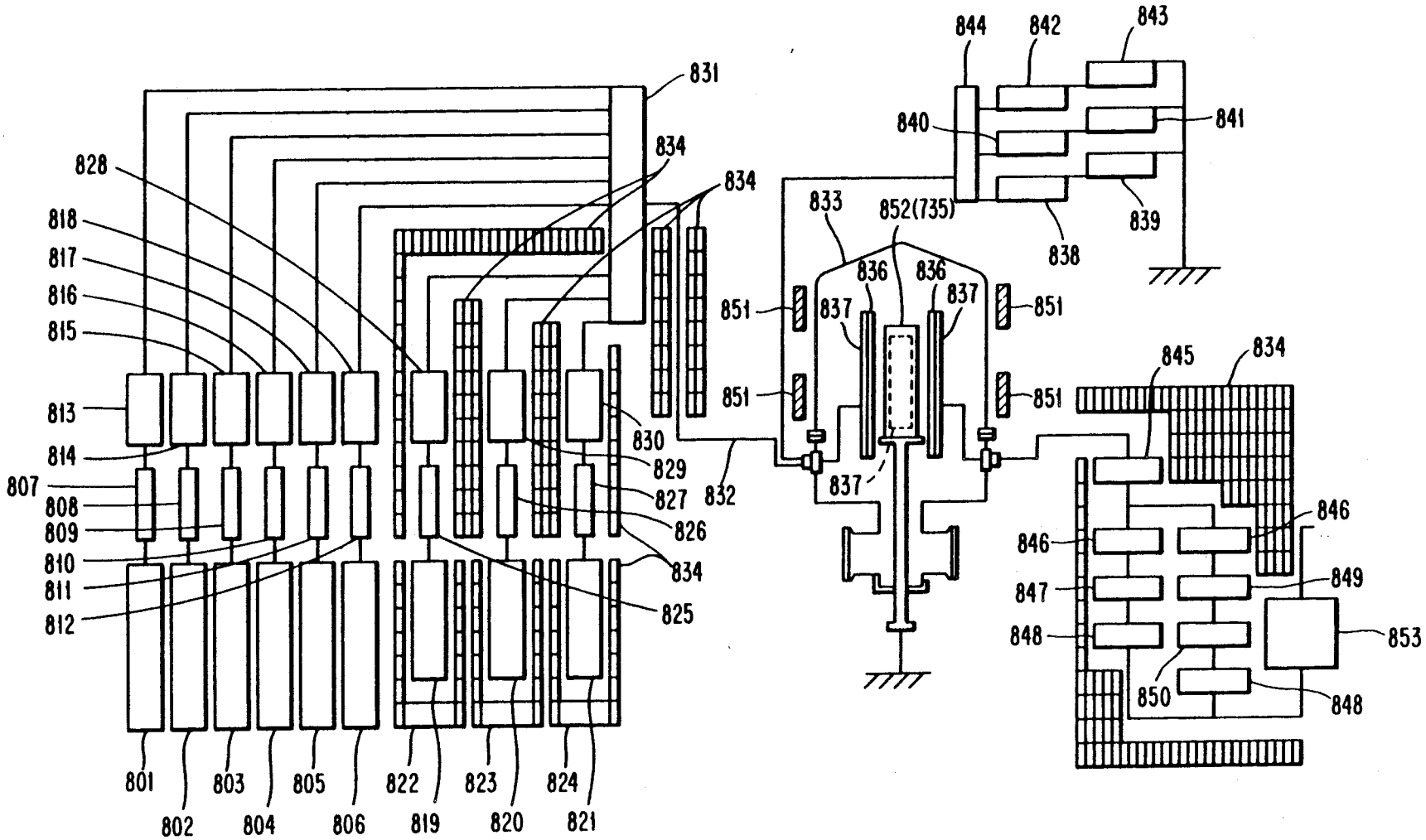

FIGS. 2 and 3 show single examples of a glow discharge decomposition apparatus for forming the overcoat layer of the present invention. FIG. 2 shows a plane-parallel plate P-CVD apparatus and FIG. 3 shows a cylindrical P-CVD apparatus.

First, an explanation of the apparatus shown in FIG. 2 follows hereinafter.

FIG. 2 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. Useful carrier gases are hydrogen gas, argon gas and helium gas. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies, for example, a low frequency of 10 KHz to 1,000 KHz, or a high frequency of 13.56 MHz and the like, is applicable to the electrode 736 by way of a connection selecting switch 744. Direct electrical power may also be additionally applied. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor.

Heaters may be selected according to the characteristics of the starting material gases to be used, but they are often unnecessary, particularly when the vaporization point of the starting material gases under normal pressure is −50° C. to +15° C., thus allowing the simplification of the manufacturing apparatus.

In general, the provision of the aforesaid heater types is preferred in order to prevent production of a fine powder polymer within the reactor 733 when the vaporization point of the strating material gases is lower than −50° C., and to prevent coalescence within the various piping when the vaporization point of the strating material gases is higher than +15° C.

Although FIG. 2 shows that the substrate 752 is fixed to the grounded electrode 735, the substrate may be attached to the power application electrode 736, or to both the electrodes.

FIG. 3 shows another type of apparatus for preparing the photosensitive member of the invention. This apparatus has the same construction as the apparatus of FIG. 2 with the exception of the interior arrangement of the reactor 833. The numerals shown by 700 order in FIG. 2 are replaced by the numerals at 800 order in FIG. 8. With reference to FIG. 3, the reactor 833 is internally provided with a hollow cylindrical electrically conductive substrate 852 serving also as the grounded electrode 735 of FIG. 2 and with an electrode heater 837 inside thereof. A power application electrode 836, similarly in the form of a hollow cylinder, is provided around the substrate 852 and surrounded by an electrode heater 837. The conductive substrate 852 is rotatable about its own axis by motor from outside.

The reactors shown in FIGS. 2 and 3 for preparing the photosensitive member are first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. A photosensitive member comprising a conductive substrate and a single photosensitive layer formed thereon and composed of selenium-arsenic alloys or a photosensitive layer composed of selenium layer having a selenium-tellurium layer laminated thereon may be used.

In order to prevent heat conversion of the selenium photosensitive layer at this time, it is desirable that the substrate temperature be set at 180° C. or less for a single layer composed of selenium-arsenic alloys, and 100° C. or less (room temperature to 100° C.) for a layer composed of selenium layer having a selenium-tellurium layer laminated thereon.

Subsequently, material gases are fed into the reactor from the first to sixth tanks and the first to third containers (i.e. from those concerned), each at a specified flow rate, using the flow controllers concerned, i.e. first to ninth flow controllers and the interior of the reactor is maintained in a predetermined vacuum of about 0.05 to 5.0 torr by the pressure control valve. After the combined flow of gases has become stabilized, the high-frequency power source, for example, is selected by the connection selecting switch to apply a low-frequency power to the power application electrode. This initiates discharge across the two electrodes, forming a solid layer on the substrate with time. The layer deposition rate is 10 angstroms/min to 3 microns/ min, with a range of 100 angstroms/min to 1 micron/min being preferable, and a range of 500 angstroms/min to 5000 angstroms/min being ideal. A layer deposition rate of less than 10 angstroms/min is undesirable from a production standpoint, while a rate greater than 3 microns/min is undesirable because it gives rise to layer unevenness. The discharge is discontinued upon the thickness reaching the desired value. Consequently, the a-C layer of the invention is obtained which serves as a overcoat layer.

A photosensitive member overcoating layer of the present invention manufactured by the aforesaid process is clearly non-crystalline as determined by the peak x-ray diffraction, contains carbon as well as hydrogen as structural atoms as determined by the peak infrared absorption based on the absorption spectrum of the carbon and hydrogen bonds, said layer is thus understood to be an amorphous hydrocarbon layer.

Furthermore, the peak absorption for a photosensitive member overcoating layer of the present invention manufactured by the aforesaid process may also be measured based on the content of halogen, chalcogen, oxygen, nitrogen or III or IV element, and carbon bonds as determined via the infrared absorption spectrum.

It is preferred that a photosensitive member overcoating layer of the present invention has a dielectric constant of about 2.0 to 6.0, with an optical band gap of about 1.5 to 3.0 [eV].

The present invention will be described with reference to the following examples.

EXAMPLES 1 and 2

Using a glow discharge decomposition apparatus shown in FIG. 3, an overcoat layer of the present invention for a photosensitive member was prepared.

First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701, butadiene gas from the second tank 702, carbon tetrafluoride gas from the third tank 703 and hydrogen sulfide gas from the fourth tank 704 into the first flow controller 713, the second flow controller 714, the third flow controller 715 and the fourth flow controller 716 respectively at an output pressure of 1.0 kg/cm$^2$.

The dials on the flow controllers were adjusted to supply the hydrogen gas at a flow rate of 300 sccm, the butadiene gas at 30 sccm, the carbon tetrafluoride gas at 90 sccm and the hydrogen sulfide gas at 3 sccm to the reactor 733 through the main pipe 732 via the intermediate mixer 731.

Further, in the member of Example 2, phosphine gas for adjusting chargeability was simultaneously introduced into the reactor 733 at a flow rate of 3 sccm.

After the flows of the gases were stabilized, the internal pressure of the reactor 733 was adjusted to 0.5 torr by the pressure control valve 745.

On the other hand, the substrate 752 was used, said substrate being a cylindrical aluminum substrate measuring 80 mm in diameter and 330 mm in length and having an Se-As photosensitive layer (Example 1) and an Se-Te photosensitive layer (Example 2) previously formed thereon to a film thickness of approximately 50 microns in accordance with conventional methods and using a separate vacuum evaporation device.

The temperature of substrate 752 was raised from room temperature to 120° C. (Example 1) or 50° C. (Example 2) about a 20 minute period prior to the introduction of the gases.

With the gas flow rates and the pressure in stabilized state, 160-watt power with a frequency of 70 KHz was applied to the power application electrode 736 from the low-frequency power source 741 preconnected thereto by the selecting switch 744 to conduct plasma polymerization for 2 minutes, forming an a-C layer, 0.2 microns in thickness, as an overcoat layer.

After completion of the film formation, the power supply was discontinued, the regulator valves except for the one for hydrogen gas were all closed. Then, only the hydrogen gas was introduced into the reactor 733 at a flow rate of 200 sccm with a pressure of 20 Torr to decrease the temperature of the substrate to 30° C. for about 15 minutes. Thereafter, the regulator valves for hydrogen gas was closed, whereupon the vacuum was broken and the photosensitive member of the present invention was removed.

When subjected to organic quantitative analysis and Auger electron spectroscopy, the a-C layer thus obtained was found to contain 45 atomic % of hydrogen atoms, 3.7 atomic % of halogen atoms, i.e., fluorine atoms and 1.2 atomic % of chalcogen atoms, i.e., sulfur atoms based on all the constituent atoms contained therein. Further, the layer was found to contain 0.9 atomic % of phosphorus atoms in Example 2.

Characteristics

The overcoat layers obtained in Examples 1 and 2 had a surface hardness of about 6 H based on measurements for pencil lead hardness as provided in Japanese Industrial Standards JIS K-5400, and it is understood that the high degree of surface hardness was a marked improvement.

Further, the member has photosensitive characteristics which is unchanged compared with the member without overcoat layer, indicating that the overcoat layer of the photosensitive member of the present invention does not impair the inherent sensitivity of the Se-Te photosensitive member.

In addition, the photosensitive members obtained in Examples 1 and 2 were exposed to atmospheric conditions of low temperature-low humidity (10° C. and 30% humidity) and high temperature-high humidity (50° C. and 90% humidity) which were alternated every 30 minutes each over a 6 hour period, and cracking or separation of the overcoat layer was not observed, from which results it is understood that the photosensitive member having the overcoat layer of the present invention has superior adhesive properties regarding its adhesion to the Se-As and Se-Te photosensitive layers When the photosensitive members obtained in Examples 1 and 2 were installed in a Minolta Model EP 650Z copy machine and copies made using a normal optical system for Example 1 and an optical system modified to a conventional semiconductor laser exposure system comprising a semiconductor laser, polygon mirror scanner, drive system and the like for Example 2, clear images were obtained. In addition, so-called image drift was not observed when copies were made under environmental conditions of 35° C. temperature and 80% humidity. Neither was any separation of the overcoat layer noted when said layer came into contact with the developer, copy paper, and cleaning components within the copy machine.

Under normal room conditions, 250,000 copies were made and clear images were obtained to the last. Additionally, the surface was subjected to component analysis after making the 250,000 copies using Auger analysis and neither selenium, tellurium, or the like were detected. From these results, it can be understood that the overcoat layer of the present invention improved the harmful aspects and increased durability while it did not impair image quality.

Evaluations after 10,000 copies, 50,000 copies, 100,000 copies or 250,000 copies, each test being conducted at 35° C. and 80% relative humidity, revealed no evidence of image drift, confirming the superior temperature resistance after printing. The results of these evaluations are shown in Table 2. In the table, the [O] mark indicates evidence of image drift detected under conditions of 35° C. and 80% relative humidity; the [Δ] mark indicates partial image drift under identical conditions; the [x] mark indicates image drift throughout the entire copy under identical conditions.

It can be understood from the aforesaid data that the photosensitive member having an overcoat layer of the present invention achieves durability without loss of image quality, and that it particularly provides superior performance in regard to moisture resistance after printing.

EXAMPLES 3 to 20

Photosensitive members were prepared as similarly as with Example 1, each member comprising a photosensitive layer and an overcoat layer provided in this order as shown in FIG. 1.

Table 1 shows the various condition values for forming an overcoat layer. Table 1 shows the conditions different from Example 1 for forming an overcoat layer and classified into 21 items (1) to (21). These items are described at the top column of the Table. Some condition values shown at each item are common to each example, while others are varying in each example.

Table 1 shows the items (1) to (21) as follows:

(1) flow rate of hydrogen gas from the first tank (701) (sccm)
(2) flow rate of material gas from the second tank (702) (sccm)
(3) flow rate of dopant gas from the third tank (703) (sccm)
(4) flow rate of dopant gas from the fourth tank (704) (sccm)
(5) flow rate of dopant gas from the fifth tank (705) (sccm)
(6) flow rate of dopant gas from the first container (719) (sccm)
(7) temperature of the first heater (722) (°C.)
(8) pressure (Torr)
(9) temperature of the substrate (°C.)
(10) time for heating the substrate (minute)
(11) dimension of the substrate (diameter × length) (unit: mm)
(12) power (watt)
(13) time for plasma polymerization (minute)
(14) thickness of the layer (micron)
(15) frequency from the power source (KHz)
(16) hydrogen content (atomic %)
(17) to (19) content of dopant contained in the overcoat layer (atomic %)
(20) photosensitive layer on which the overcoat layer is formed. In this, A represents Se-As layer and B represents Se-Te layer
(21) thickness of the photosensitive layer Molecular formulas shown in Table 1 represent following compounds:

$C_3H_6$: propylene
$C_3F_6$: perfluoropropylene
$H_2Se$: hydrogenated selenium
$C_4H_6$: butadiene
$CF_4$: carbon tetrafluoride
$B_2H_6$: diborane
$PH_3$: phosphine
$(CH_3)_3Al$: trimethylaluminum
$CO_2$: carbon dioxide
$NH_3$: ammonia
$SiH_4$: monosilane
$GeH_4$: germane In Examples 3 to 20, after completion of the film formation, the power supply was discontinued, the regulator valve except for the one for hydrogen gas were all closed. Then, only the hydrogen gas was introduced into the reactor 733 at a flow rate of 200 sccm with a pressure of 20 Torr to decrease the temperature of the substrate to 30° C. for about 15 minutes.

Characteristics

The photosensitive members obtained in Examples 3 to 20 have almost the same characteristics as that in Example 1. From these results, it can be understood that the photosensitive member having an overcoat layer of the present invention achieves durability without loss of image quality, and that it particularly provides superior performance in regard to moisture resistance after printing. The results of evaluations for each Example are shown in Table 1.

COMPARATIVE EXAMPLES 1 AND 2

Overcoat layers were formed on an Se-As photosensitive member (Comparative Example 1) and an Se-Te photosensitive member (Comparative Example 2) as per Examples 1 and 2 except for omitting the inflow of hydrogen sulfide gas.

The overcoat layers obtained in Comparative Examples 1 and 2 exhibited poor moisture resistance after printing as shown in Table 1 due to the absence of chalcogen atoms, thus confirming their impracticality.

COMPARATIVE EXAMPLES 3 AND 4

Overcoat layers were formed on an Se-As photosensitive member (Comparative Example 3) and an Se-Te photosensitive member (Comparative Example 4) as per Examples 3 and 4 except for omitting the inflow of perfluoropropylene gas.

The overcoat layers obtained in Comparative Examples 3 and 4 exhibited poor moisture resistance after printing as shown in Table 1 due to the absence of halogen atoms, thus confirming their impracticality.

COMPARATIVE EXAMPLES 5 AND 6

Overcoat layers were formed on an Se-As photosensitive member (Comparative Example 5) and an Se-Te photosensitive member (Comparative Example 6) as per Examples 1 and 2 except for omitting the inflow of carbon tetrafluoride gas and hydrogen sulfide gas.

The overcoat layers obtained in Comparative Examples 5 and 6 exhibited poor moisture resistance after printing as shown in Table 1 and produced image drift under high temperature conditions prior to use in resistance tests due to the absence of chalcogen atoms and halogen atoms, thus confirming their impracticality.

TABLE 1

| Ex No | (1) sccm | (2) sccm | | (3) sccm | | (4) sccm | | (5) sccm | | (6) sccm | | (7) °C. | (8) Torr | (9) °C. | (10) min |
|---|---|---|---|---|---|---|---|---|---|---|---|---|---|---|---|
| 3 | 300 | $C_3H_6$ | 30 | $C_3F_6$ | 90 | $H_2Se$ | 4 | — | — | — | — | — | 0.5 | 50 | 20 |
| 4 | 300 | $C_3H_6$ | 30 | $C_3F_6$ | 90 | $H_2Se$ | 4 | $PH_3$ | 2 | — | — | — | 0.5 | 50 | 20 |
| 5 | 300 | $C_4H_6$ | 30 | $CF_4$ | 90 | $B_2H_6$ | 3 | — | — | — | — | — | 0.5 | 120 | 20 |
| 6 | 300 | $C_4H_6$ | 30 | $CF_4$ | 90 | $B_2H_6$ | 3 | $PH_3$ | 2 | — | — | — | 0.5 | 50 | 20 |
| 7 | 300 | $C_3H_6$ | 30 | $C_3F_6$ | 90 | — | — | — | — | $(CH_3)_3Al$ | 4 | 65 | 0.5 | 50 | 20 |
| 8 | 300 | $C_3H_6$ | 30 | $C_3F_6$ | 90 | — | — | $PH_3$ | 2 | $(CH_3)_3Al$ | 4 | 65 | 0.5 | 50 | 20 |
| 9 | 300 | $C_4H_6$ | 30 | $CF_4$ | 90 | $CO_2$ | 20 | — | — | — | — | — | 0.5 | 120 | 20 |
| 10 | 300 | $C_4H_6$ | 30 | $CF_4$ | 90 | $CO_2$ | 20 | $PH_3$ | 2 | — | — | — | 0.5 | 50 | 20 |
| 11 | 300 | $C_3H_6$ | 30 | $C_3F_6$ | 90 | $O_2$ | 10 | — | — | — | — | — | 0.5 | 50 | 20 |
| 12 | 300 | $C_3H_6$ | 30 | $C_3F_6$ | 90 | $O_2$ | 10 | $PH_3$ | 2 | — | — | — | 0.5 | 50 | 20 |
| 13 | 300 | $C_4H_6$ | 30 | $CF_4$ | 90 | $N_2$ | 20 | — | — | — | — | — | 0.5 | 120 | 20 |
| 14 | 300 | $C_4H_6$ | 30 | $CF_4$ | 90 | $N_2$ | 20 | $PH_3$ | 3 | — | — | — | 0.5 | 50 | 20 |
| 15 | 300 | $C_3H_6$ | 30 | $C_3F_6$ | 90 | $NH_3$ | 10 | — | — | — | — | — | 0.5 | 50 | 20 |
| 16 | 300 | $C_3H_6$ | 30 | $C_3F_6$ | 90 | $NH_3$ | 10 | $PH_3$ | 2 | — | — | — | 0.5 | 50 | 20 |
| 17 | 300 | $C_4H_6$ | 30 | $CF_4$ | 90 | $SiH_4$ | 3 | — | — | — | — | — | 0.5 | 120 | 20 |
| 18 | 300 | $C_4H_6$ | 30 | $CF_4$ | 90 | $SiH_4$ | 3 | $PH_3$ | 3 | — | — | — | 0.5 | 50 | 20 |
| 19 | 300 | $C_3H_6$ | 30 | $C_3F_6$ | 90 | $GeH_4$ | 4 | — | — | — | — | — | 0.5 | 50 | 20 |
| 20 | 300 | $C_3H_6$ | 30 | $C_3F_6$ | 90 | $GeH_4$ | 4 | $PH_3$ | 2 | — | — | — | 0.5 | 50 | 20 |

| Ex No | (11) mm | (12) watt | (13) min | (14) μm | (15) KHz | (16) at. % | (17) at. % | | (18) at. % | | (19) at. % | | (20) | (21) μm |
|---|---|---|---|---|---|---|---|---|---|---|---|---|---|---|
| 3 | 80 × 330 | 200 | 2 | 0.25 | 125 | 45 | F | 2.7 | Se | 1.9 | — | — | A | 50 |
| 4 | 80 × 330 | 200 | 2 | 0.25 | 125 | 45 | F | 2.7 | Se | 1.9 | P | 0.5 | B | 50 |
| 5 | 80 × 330 | 160 | 2 | 0.2 | 70 | 45 | F | 3.7 | B | 0.8 | — | — | A | 50 |
| 6 | 80 × 330 | 160 | 2 | 0.2 | 70 | 45 | F | 3.7 | B | 0.8 | P | 0.6 | B | 50 |
| 7 | 80 × 330 | 200 | 2 | 0.25 | 125 | 45 | F | 2.7 | Al | 2.5 | — | — | A | 50 |
| 8 | 80 × 330 | 200 | 2 | 0.25 | 125 | 45 | F | 2.7 | Al | 2.5 | P | 0.5 | B | 50 |
| 9 | 80 × 330 | 160 | 2 | 0.2 | 70 | 45 | F | 3.7 | O | 1.4 | — | — | A | 50 |
| 10 | 80 × 330 | 160 | 2 | 0.2 | 70 | 45 | F | 3.7 | O | 1.4 | P | 0.9 | B | 50 |
| 11 | 80 × 330 | 200 | 2 | 0.25 | 125 | 45 | F | 2.7 | O | 0.8 | — | — | A | 50 |
| 12 | 80 × 330 | 200 | 2 | 0.25 | 125 | 45 | F | 2.7 | O | 0.8 | P | 0.5 | B | 50 |
| 13 | 80 × 330 | 160 | 2 | 0.2 | 70 | 45 | F | 3.7 | N | 1.2 | — | — | A | 50 |
| 14 | 80 × 330 | 160 | 2 | 0.2 | 70 | 45 | F | 3.7 | N | 1.2 | P | 0.9 | B | 50 |
| 15 | 80 × 330 | 200 | 2 | 0.25 | 125 | 45 | F | 2.7 | N | 1.0 | — | — | A | 50 |
| 16 | 80 × 330 | 200 | 2 | 0.25 | 125 | 45 | F | 2.7 | N | 1.0 | P | 0.5 | B | 50 |
| 17 | 80 × 330 | 160 | 2 | 0.2 | 70 | 45 | F | 3.7 | Si | 3.7 | — | — | A | 50 |

TABLE 1-continued

| | | | | | | | | | | | | | | |
|---|---|---|---|---|---|---|---|---|---|---|---|---|---|---|
| 18 | 80 × 330 | 160 | 2 | 0.2 | 70 | 45 | F | 3.7 | Si | 3.7 | P | 0.8 | B | 50 |
| 19 | 80 × 330 | 200 | 2 | 0.25 | 125 | 45 | F | 2.7 | Ge | 4.6 | — | — | A | 50 |
| 20 | 80 × 330 | 200 | 2 | 0.25 | 125 | 45 | F | 2.7 | Ge | 4.6 | P | 0.5 | B | 50 |

TABLE 2

| Example | No. Copies 10,000 | No. Copies 50,000 | No. Copies 100,000 | No. Copies 250,000 |
|---|---|---|---|---|
| Ex. 1 | O | O | O | O |
| Ex. 2 | O | O | O | O |
| Ex. 3 | O | O | O | O |
| Ex. 4 | O | O | O | O |
| Ex. 5 | O | O | O | O |
| Ex. 6 | O | O | O | O |
| Ex. 7 | O | O | O | O |
| Ex. 8 | O | O | O | O |
| Ex. 9 | O | O | O | O |
| Ex. 10 | O | O | O | O |
| Ex. 11 | O | O | O | O |
| Ex. 12 | O | O | O | O |
| Ex. 13 | O | O | O | O |
| Ex. 14 | O | O | O | O |
| Ex. 15 | O | O | O | O |
| Ex. 16 | O | O | O | O |
| Ex. 17 | O | O | O | O |
| Ex. 18 | O | O | O | O |
| Ex. 19 | O | O | O | O |
| Ex. 20 | O | O | O | O |
| Com. Ex. 1 | O | Δ | X | X |
| Com. Ex. 2 | O | Δ | X | X |
| Com. Ex. 3 | Δ | X | X | X |
| Com. Ex. 4 | X | X | X | X |

What is claimed is:

1. A photosensitive member comprising:

an electrically conductive substrate;

a photoconductive layer for retaining and transporting charges, said photoconductive layer comprising a selenium-arsenic alloy layer or comprising a selenium layer and selenium-tellurium layer formed in this order; and an overcoat layer formed on said photoconductive layer and comprising amorphous carbon containing hydrogen, said overcoat layer containing halogen atoms and at least one element selected from the group consisting of chalcogen, oxygen, nitrogen and elements in Group III and IV of the periodic table.

2. A photosensitive member as claimed in claim 1 wherein the amount of the hydrogen contained in the overcoat layer is about 5 to 50 atomic % based on the combined amount of hydrogen and carbon therein.

3. A photosensitive member as claimed in claim 1 wherein the amount of halogen atoms contained in the overcoat layer is about 0.01 to about 50 atomic % based on all the constituent atom therein.

4. A photosensitive member as claimed in claim 3 wherein the amount of halogen atoms contained in the overcoat layer is preferably about 0.1 to about 10 atomic % based on all the constituent atoms therein.

5. A photosensitive member as claimed in claim 1 wherein the amount of the chalcogen contained in the overcoat layer is about 0.01 to about 20 atomic % based on all the constituent atoms therein.

6. A photosensitive member as claimed in claim 1 wherein the amount of the oxygen contained in the overcoat layer is about 0.01 to about 20 atomic % based on all the constituent atoms therein.

7. A photosensitive member as claimed in claim 1 wherein the amount of the nitrogen contained in the overcoat layer is about 0.01 to about 20 atomic % based on all the constituent atoms therein.

8. A photosensitive member as claimed in claim 1 wherein the amount of the elements in Group III of the periodic table contained in the overcoat layer is about 0.01 to 20 atomic % based on all the constituent atoms therein.

9. A photosensitive member as claimed in claim 1 wherein the amount of the elements in Group IV of the periodic table contained in the overcoat layer is about 0.01 to about 40 atomic % based on all the constituent atoms therein.

10. A photosensitive member as claimed in claim 1 wherein said overcoat layer is prepared by organic plasma polymerization.

11. A photosensitive member as claimed in claim 1 wherein the thickness of the overcoat layer is about 0.01 to about 5 microns.

* * * * *

UNITED STATES PATENT AND TRADEMARK OFFICE

CERTIFICATE OF CORRECTION

PATENT NO. : 4,994,337

DATED : February 19, 1991

INVENTOR(S) : Kenji MASAKI, et al.

It is certified that error appears in the above-identified patent and that said Letters Patent is hereby corrected as shown below:

On the title page:

[30] FOREIGN APPLICATION PRIORITY DATA

The first application shown should read:

Jun. 17, 1987 [JP] Japan ..... 62-150895

Signed and Sealed this

Eighteenth Day of June, 1991

*Attest:*

*Attesting Officer*

HARRY F. MANBECK, JR.

*Commissioner of Patents and Trademarks*